US010265825B2

(12) United States Patent
Murase et al.

(10) Patent No.: US 10,265,825 B2
(45) Date of Patent: Apr. 23, 2019

(54) TRAVEL PATH GRINDING AND TRAVEL PATH GRINDING METHOD

(71) Applicant: Mitsubishi Heavy Industries Engineering, Ltd., Yokohama-shi, Kanagawa (JP)

(72) Inventors: Kosaku Murase, Tokyo (JP); Kenta Fukaya, Tokyo (JP)

(73) Assignee: MITSUBISHI HEAVY INDUSTRIES ENGINEERING, LTD., Kanagawa (JP)

( * ) Notice: Subject to any disclaimer, the term of this patent is extended or adjusted under 35 U.S.C. 154(b) by 0 days.

(21) Appl. No.: 15/511,728

(22) PCT Filed: Sep. 11, 2015

(86) PCT No.: PCT/JP2015/075863
§ 371 (c)(1),
(2) Date: Mar. 16, 2017

(87) PCT Pub. No.: WO2016/052143
PCT Pub. Date: Apr. 7, 2016

(65) Prior Publication Data

US 2017/0304985 A1 Oct. 26, 2017

(30) Foreign Application Priority Data

Sep. 29, 2014 (JP) ..... 2014-197825

(51) Int. Cl.
*B24B 19/00* (2006.01)
*B24B 7/10* (2006.01)
(Continued)

(52) U.S. Cl.
CPC ..... *B24B 19/004* (2013.01); *B24B 7/005* (2013.01); *B24B 7/10* (2013.01); *B24B 7/18* (2013.01);
(Continued)

(58) Field of Classification Search
CPC ..... B24B 19/004; B24B 23/08; B24B 41/02; B24B 7/10; B24B 27/00; B24B 27/0007;
(Continued)

(56) References Cited

U.S. PATENT DOCUMENTS 3,566,546 A * 3/1971 Lindmark ..... B24B 19/004 451/302
4,523,542 A * 6/1985 Imahori ..... E01B 25/28 118/108
(Continued)

FOREIGN PATENT DOCUMENTS

CN 2659938 Y 12/2004
CN 1669738 A 9/2005
(Continued)

OTHER PUBLICATIONS

McMaster Carr Catalog—pp. 1203 1190 and 1984—Parts Availability before Sep. 1, 2014.*
(Continued)

*Primary Examiner* — Marc Carlson
(74) *Attorney, Agent, or Firm* — Kanesaka Berner and Partners LLP

(57) ABSTRACT

A grinding device of a travel path, on which traveling wheels of a rail-type vehicle roll, includes a grinder which grinds a surface layer of a travel path, a frame on which the grinder is provided, and a device traveling wheel mounted on the frame. The device traveling wheel rolls along the travel path on the top surface of the standard rail extending in the extending direction of the travel path.

14 Claims, 12 Drawing Sheets

(51) Int. Cl.

| | |
|---|---|
| ***B24B 23/08*** | (2006.01) |
| ***B24B 41/02*** | (2006.01) |
| ***B24B 27/00*** | (2006.01) |
| ***B24B 7/18*** | (2006.01) |
| ***B24B 7/00*** | (2006.01) |

(52) U.S. Cl.
CPC ..... *B24B 23/08* (2013.01); *B24B 27/00* (2013.01); *B24B 27/0007* (2013.01); *B24B 27/0015* (2013.01); *B24B 27/0076* (2013.01); *B24B 41/02* (2013.01)

(58) Field of Classification Search
CPC . B24B 27/0015; B24B 27/0076; B24B 7/005; B24B 7/18
See application file for complete search history.

(56) References Cited

U.S. PATENT DOCUMENTS

| | | | | | |
|---|---|---|---|---|---|
| 4,854,088 | A * | 8/1989 | Clem | B24B 19/004 | 451/28 |
| 2001/0029160 | A1* | 10/2001 | Aznal | B23Q 1/012 | 451/194 |
| 2011/0198767 | A1* | 8/2011 | Kang | E01B 25/28 | 264/35 |
| 2015/0111472 | A1* | 4/2015 | Palese | B24B 49/12 | 451/5 |
| 2015/0290761 | A1* | 10/2015 | Richardson | B24B 7/182 | 451/41 |
| 2017/0284034 | A1* | 10/2017 | Weatherill | B24B 23/00 | |

FOREIGN PATENT DOCUMENTS

| | | | | | |
|---|---|---|---|---|---|
| CN | 101666066 | A | | 3/2010 | |
| CN | 202462137 | U | | 10/2012 | |
| EP | 0576891 | A1 | * | 1/1994 | E01B 31/17 |
| GB | 1041201 | A | * | 9/1966 | B24B 19/004 |
| JP | S60-80602 | A | | 5/1985 | |
| JP | S61-180202 | U | | 11/1986 | |
| JP | 2006-297563 | A | | 11/2006 | |
| JP | 2010-201584 | A | | 9/2010 | |
| JP | 2010201584 | A | * | 9/2010 | |
| JP | 2012-505330 | A | | 3/2012 | |
| KR | 10-2010-0044540 | A | | 4/2010 | |
| KR | 20100044540 | A | * | 4/2010 | |
| WO | 2010/044514 | A1 | | 4/2010 | |
| WO | WO 2012146540 | A1 | * | 11/2012 | B24B 19/004 |

OTHER PUBLICATIONS

McMaster Carr—Evidence of Prior Art Parts Availability before Sep. 1, 2014.*
EP 0576891 A1 (Jan. 1994)—English machine translation.*
KR 20100044540 A (Apr. 2010)—English Machine Translation.*
International Search Report in International Application No. PCT/JP2015/015863, dated Nov. 24, 2015.
Written Opinion in International Application No. PCT/JP2015/075863, dated Nov. 24, 2015.

* cited by examiner

TRAVEL PATH GRINDING AND TRAVEL PATH GRINDING METHOD

RELATED APPLICATIONS

The present application is a National Phase of PCT/JP2015/075863, filed, Sep. 11, 2015, and claims priority based on Japanese Patent Application No. 2014-197825, filed Sep. 29, 2014.

TECHNICAL FIELD

The present invention relates to a grinding device for a travel path on which traveling wheels of a rail-type vehicle roll and a grinding method for travel path.

Priority is claimed on Japanese Patent Application No. 2014-197825, filed Sep. 29, 2014, the content of which is incorporated herein by reference.

BACKGROUND ART

In recent years, new transportation systems have attracted attention as new transportation means other than buses and railways. As one type of such new transportation systems, a type which allows a vehicle having traveling wheels formed of rubber tires to travel on tracks is known.

The tracks on which this type of vehicle travels are configured to have concrete travel paths on which the traveling wheels roll, and guide rails as guide tracks provided along the travel paths. The vehicle has guide wheels in addition to the traveling wheels, and a traveling direction is restricted by bringing the guide wheels into contact with the guide rails provided along the travel paths.

As one of factors for improving the ride quality of this type of vehicle, there is flatness of the travel paths. As a method for enhancing the flatness of the concrete surface, for example, as described in the following Patent Document 1, there is a method of grinding the surface of the concrete after curing using a grinding device. This grinding device includes grinders, a frame on which the grinders are provided, and a vacuum pad which holds the frame on the surface to be machined by suctioning a surface to be machined. This device is used for grinding an installation floor surface for a device which requires installation accuracy, such as a high precision machining device or an analytical device.

CITATION LIST

Patent Document

[Patent Document 1]

Japanese Unexamined Patent Application, First Publication No. 2006-297563

SUMMARY OF INVENTION

Technical Problem

The aforementioned grinding device is suitable for grinding the floor surface within a limited range. However, when grinding the travel paths on which the traveling wheels of the rail-type vehicle roll, using the grinding device, the grinding device is positioned at a specific position on the travel paths, and the portion of the travel paths at that position is ground. Thereafter, the grinding device is slightly moved along the travel paths, and the portion of the travel paths at the position after the movement is ground. After that, this work is repeated many times. For this reason, there is a problem that it is not possible to efficiently grind the travel paths by the grinding device.

Therefore, an object of the present invention is to provide a grinding device capable of efficiently grinding the travel path on which traveling wheels of a rail-type vehicle roll, and a grinding method of travel path.

Solution to Problem

In order to achieve the aforementioned objects, according to an aspect of the present invention, there is provided a travel path grinding device for grinding a travel path on which traveling wheels of a rail-type vehicle roll, the device including: a grinder which grinds a surface layer of the travel path; a frame on which the grinder is provided; and a device traveling wheel which is mounted on the frame, and rolls along the travel path on top surface of standard rail extending in an extending direction of the travel path.

In the grinding device, the surface layer of the travel path can be ground by the grinder, while the device traveling wheel rolls on the standard rail and the grinding device is traveling.

Here, in the travel path grinding device, in a state in which the device traveling wheel comes into contact with the top surface of the standard rail, at a position where a grinding tool mounted onto a spindle of the grinder is capable of coming into contact with a portion of the travel path to be ground, the grinder may be provided in the frame.

Further, in the travel path grinding device, the device traveling wheel may include a wheel body in which a tread surface coming into contact with the top surface of the standard rail is formed on an outer periphery thereof, and a flange which is provided on the wheel body and is capable of coming into contact with the standard rail from a width direction of the travel path.

In the grinding device, during travel, relative position change with respect to the standard rail in the width direction is restricted by the flange of the device traveling wheel. Therefore, in the grinding device, even if the travel path is ground during travel, the relative position of the grinding region with respect to the standard rail in the width direction can be made substantially constant.

Further, the travel path grinding device may include a grinder moving mechanism which relatively moves the grinder with respect to the frame.

In the grinding device, it is possible to adjust the grinding position of the grinders. For example, if the grinder can be relatively moved in the width direction of the travel path, the position of the grinding region in the width direction can be adjusted. Also, if the grinder can be relatively moved in the vertical direction, the grinding depth of the grinder can be adjusted.

In the traveling road grinding device provided with the grinder moving mechanism, the grinder moving mechanism may relatively move the grinder in the vertical direction with respect to the frame.

In the grinding device, as described above, the grinding depth of the grinder can be adjusted.

In the travel path grinding device, a spindle of the grinder on which a grinding tool is mounted may extend in the vertical direction.

In the grinding device, it is possible to grind the travel path over a wide range in the width direction of the travel path in a single run, by mounting the grinding tool, which has a disk shape and has an end surface forming a main grinding surface, on the spindle.

Further, the travel path grinding device may include a device guide wheel which is mounted on the frame and faces a bottom surface of the standard rail to sandwich the standard rail from the vertical direction between the device traveling wheel and the device guide wheel.

In the grinding device, it is possible to suppress relative displacement in the vertical direction of the traveling device with respect to the standard rail.

Further, the travel path grinding may include a plurality of the grinders.

In this grinding device, it is possible to efficiently grind the travel path.

In the travel path grinding device provided with the plurality of the grinders, at least some grinders among the plurality of the grinders may be arranged side by side in the width direction of the travel path and mounted onto the frame.

When there are two travel paths extending in the extending direction, by mounting a dedicated grinder for grinding each travel path to the frame, it is possible to grind the two travel paths in a single run. Further, even when the width of the region to be ground in the travel paths is wider than the grinding width of a single grinding tool, it is possible to grind the travel path over the entire width of the region to be ground in a single travel.

In the travel path grinding device provided with a plurality of the grinders, at least some grinders among the plurality of the grinders may be arranged side by side in the extending direction of the travel path and mounted onto the frame.

In the grinders, among the plurality of the grinders arranged in the extending direction of the travel path, the region ground by a front grinder can be further ground by a rear grinder. For this reason, for example, after performing rough grinding with the front grinder, it is possible to finish grinding the roughly ground region with the rear grinder.

The travel path grinding device may further include a mounting structure which detachably mounts the grinder on the frame.

Further, the travel path grinding device may be provided with auxiliary traveling wheels which are attachably and detachably mounted onto the frame and roll on the top surface of the travel path.

In the grinding device, by rolling the auxiliary traveling wheels and causing the grinding device to travel, it is possible to easily move the grinding device, irrespective of the presence or absence of the standard rail.

According to another aspect of the present invention, there is provided a travel path grinding method for grinding the travel path, using the grinding device, the method including: causing the grinding device to travel along the travel path so that the device traveling wheel of the grinding device rolls on the top surface of the standard rail; and grinding the surface layer of the travel path by driving the grinders during travel.

In the grinding method, while the grinding device is traveling, the surface layer of the travel path can be ground with the grinder.

Here, in the travel path grinding method, during travel, guide rails with which the guide wheels of the rail-type vehicle come into contact to guide the direction of the rail-type vehicle are used as the standard rail.

According to the grinding method, equipment costs can be minimized as compared with the case where the standard rail are provided separately.

Advantageous Effects of Invention

According to an aspect of the present invention, while the device traveling wheel rolls on the standard rail and the grinding device is traveling, it is possible to grind the surface layer of the travel path on which the traveling wheels of the rail-type vehicle roll, using a grinder. Therefore, according to an aspect of the present invention, it is possible to efficiently grind the travel path.

DESCRIPTION OF EMBODIMENTS

Hereinafter, embodiments and various modified examples of the travel path grinding device and the grinding method according to the present invention will be described with reference to the drawings.

Embodiment of Track and Guide Track Type Vehicle

Figure 10:
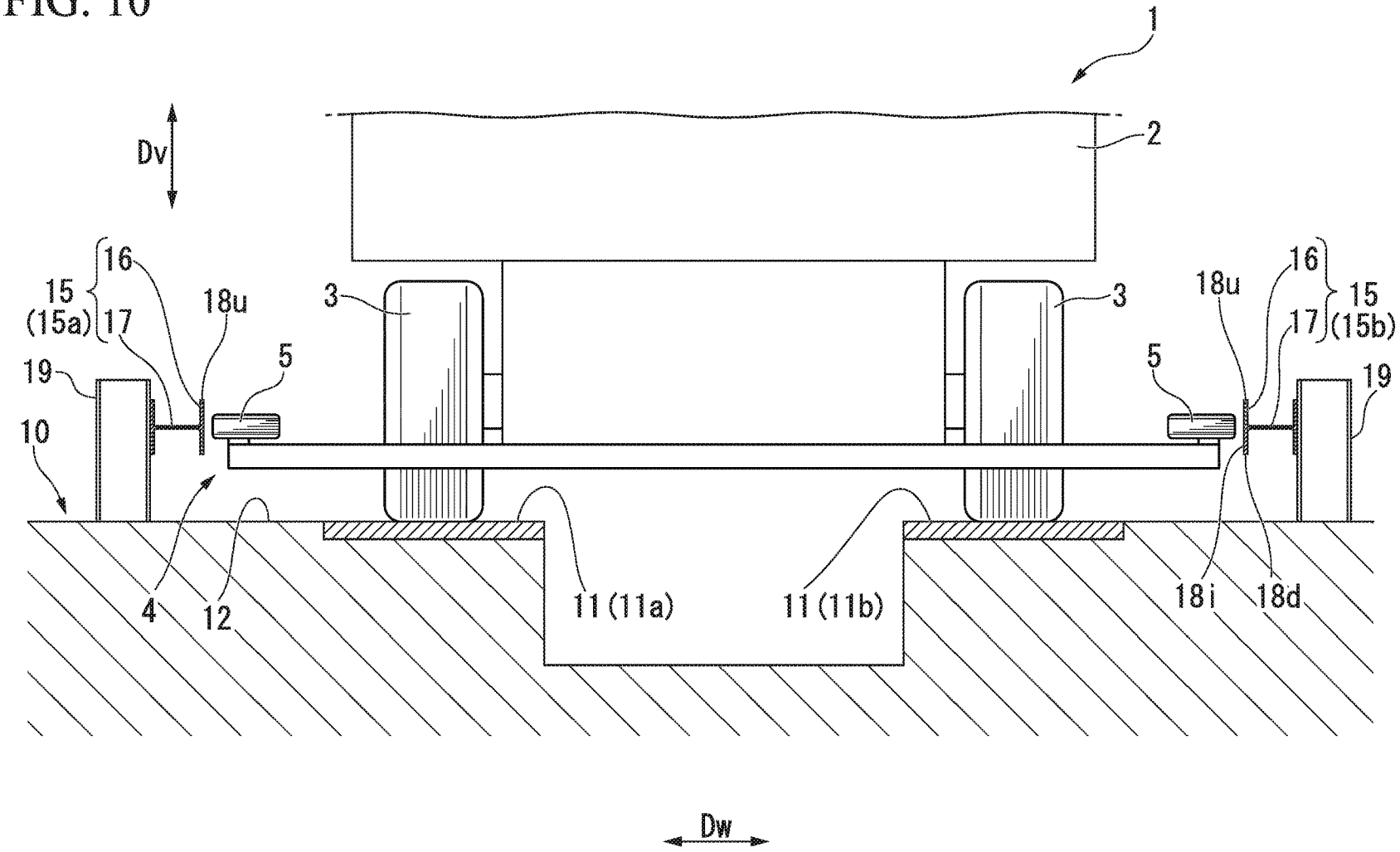
FIG. 10 is a rear view of a rail-type vehicle according to an embodiment of the present invention.

Before describing embodiments of the travel path grinding device and the grinding method, embodiments of the track having the travel path and the rail-type vehicle will be described with reference to FIG. 10.

The vehicle of the present embodiment is a vehicle of a side guide rail-type new transportation system. This vehicle, that is, a rail-type vehicle 1 includes a vehicle body 2, a pair of left and right traveling tires (traveling wheels) 3 disposed at a lower portion of the vehicle body 2, and a guide device 4 which guides the rail-type vehicle 1 in a target traveling direction. The guide device 4 has a pair of left and right guide wheels 5 which are rotatable about an axis extending in a vertical direction Dv.

The track on which the rail-type vehicle 1 of the present embodiment runs is a side type guide track 10. This side type guide track 10 (hereinafter, simply referred to as a track 10)

is configured to have a pair of left and right travel paths 11 on which the traveling tires 3 roll, a travel path forming surface 12 on which the travel paths 11 are provided, and a pair of left and right side guide rails 15 as side type guiding rails (hereinafter, simply referred to as guide rails 15).

Hereinafter, a direction in which the travel path 11 extends will be referred to as an extending direction De, and a width direction of the travel path 11 will simply be referred to as a width direction Dw or a lateral direction. Further, in the present embodiment, a vertical direction Dv is an ideal direction perpendicular to the top surface of the travel path 11, unlike a vertical direction in an accurate sense.

The travel path forming surface 12 extends in the extending direction De similarly to the travel path 11. Further, the travel path forming surface 12 extends not only to the region of the travel path 11 but also to both sides of the travel path 11. Both of the pair of left and right guide rails 15 extend in the extending direction De similarly to the travel path 11. A left first guide rail 15*a* of the pair of left and right guide rails 15 is disposed on the left side of a left first travel path 11*a* of the pair of left and right travel paths 11. A right second guide rail 15*b* of the pair of left and right guide rails 15 is disposed on the right side of the right second travel path 11*b*. The guide rail 15 is supported at a position above the top surface of the travel path 11 by a plurality of rail support posts 19 or the like disposed on the travel path forming surface 12 at intervals in the extending direction De.

In the present embodiment, the guide rail 15 is formed of H-shaped steel having a pair of flanges 16 facing each other and a web 17 connecting the pair of flanges 16. The guide rail 15 is supported by the rail support post 19 or the like so that the web 17 faces in the horizontal direction and the pair of flanges 16 are aligned in the width direction Dw. The guide wheels 5 of the rail-type vehicle 1 come into contact with a surface 18*i* (hereinafter, referred to as the inner surface 18*i* of the guide rail 15) facing the travel path 11 side, due to a flange 16 of the travel path 11 side in the width direction Dw, among the pair of flanges 16 in the guide rail 15.

Embodiment of Grinding Device and Grinding Method for Travel Paths

An embodiment of a grinding device and a grinding method of the travel path 11 of the track 10 will be described with reference to FIGS. 1 to 9.

Figure 1:
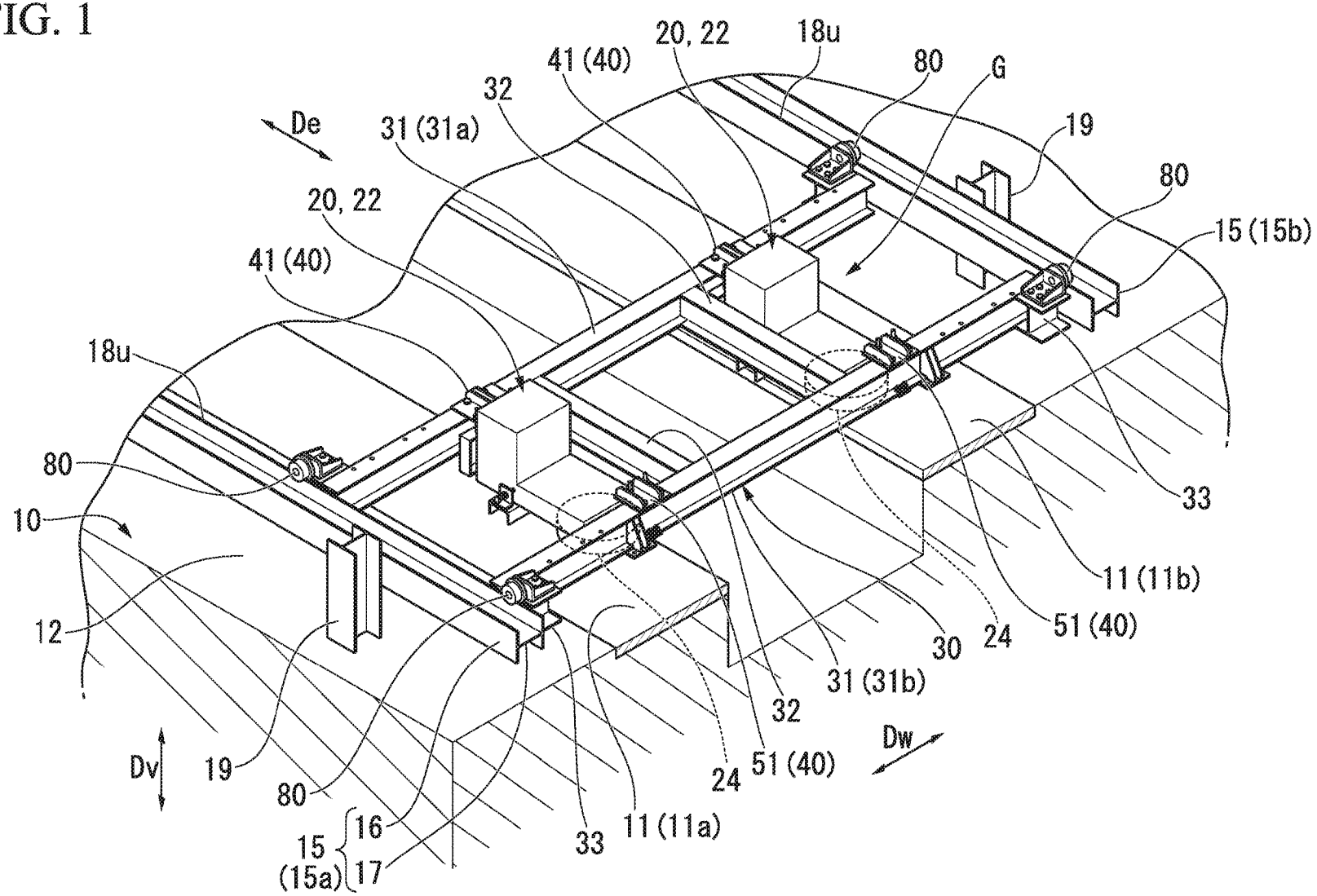
FIG. 1 is a perspective view of a grinding device according to an embodiment of the present invention.
Figure 2:
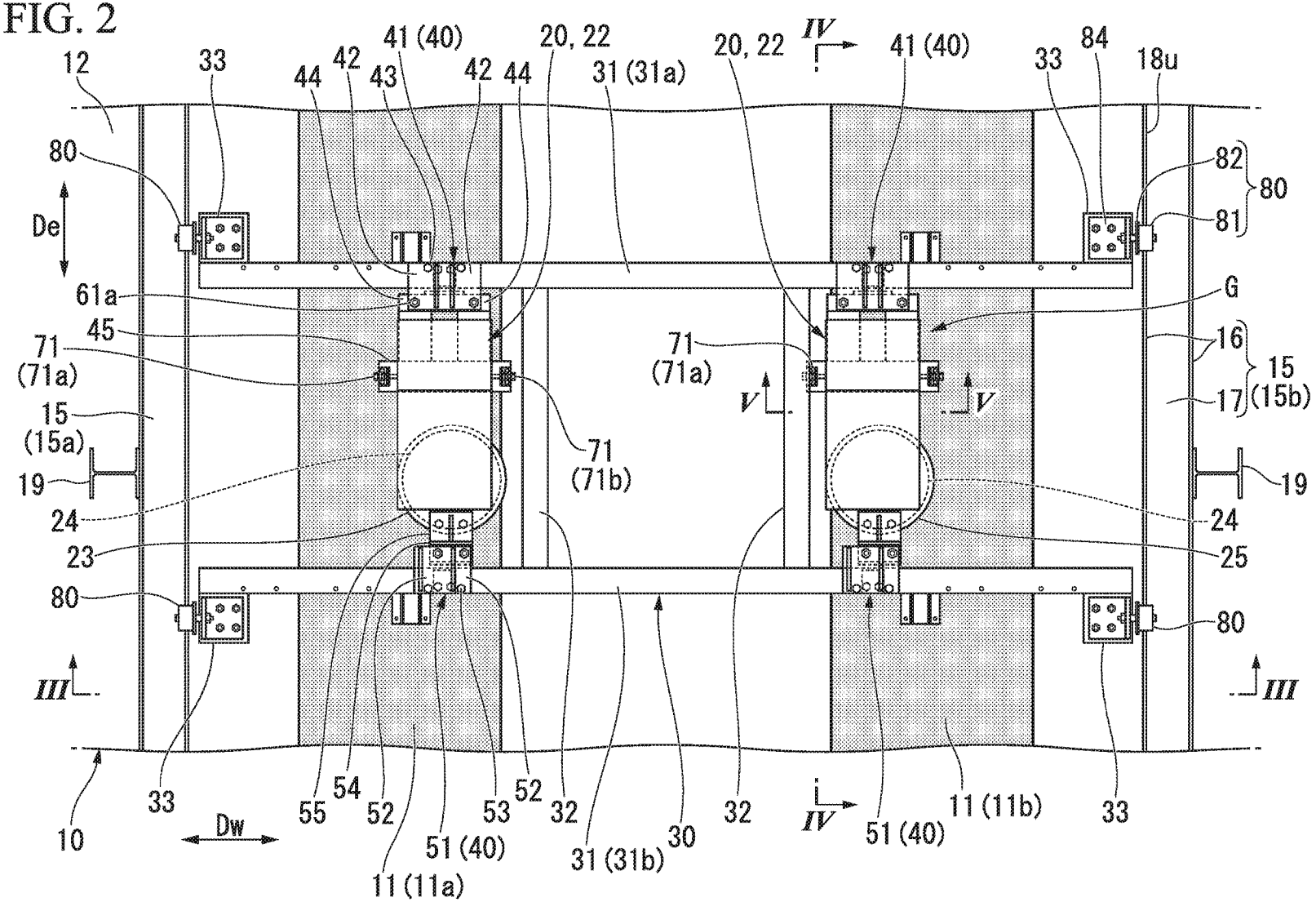
FIG. 2 is a plan view of the grinding device according to an embodiment of the present invention.
Figure 3:
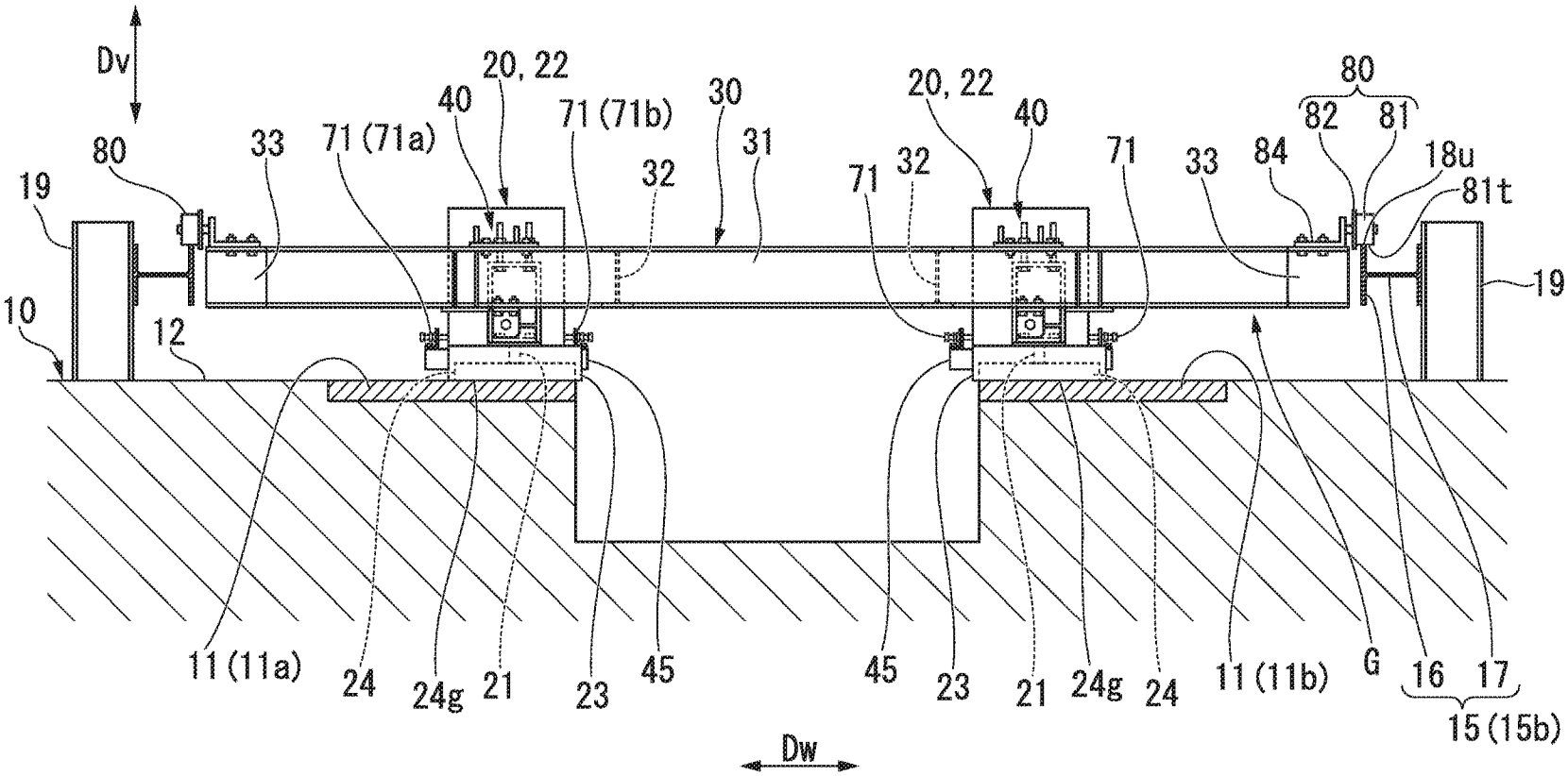
FIG. 3 is a cross-sectional view taken along line III-III in FIG. 2.

As shown in FIGS. 1 to 3, the grinding device G of this embodiment includes a grinder 20 which grinds the surface layer of the travel path 11, a frame 30 on which the grinder 20 is provided, a mounting structure 40 for mounting the grinder 20 on the frame 30 in a freely detachable manner, and device traveling wheels 80 which are mounted on the frame 30 and roll on the top surface 18*u* of the guide rail (standard rail) 15.

The frame 30 has a pair of beam members 31 extending in the width direction Dw and facing each other in the extending direction De, a pair of girder members 32 extending in the extending direction De and facing each other in the width direction Dw to connect the pair of beam members 31, and traveling wheel mounting bases 33 on which the device traveling wheels 80 are mounted. Here, all of the beam members 31, the girder members 32 and the traveling wheel mounting bases 33 are formed of H-shaped steel.

The traveling wheel mounting bases 33 are fixed to each of both ends of the pair of beam members 31 in the width direction Dw. Therefore, the grinding device G of the present embodiment has each of the four traveling wheel mounting bases 33, and the four device traveling wheels 80 mounted onto the traveling wheel mounting bases 33.

Figure 8:
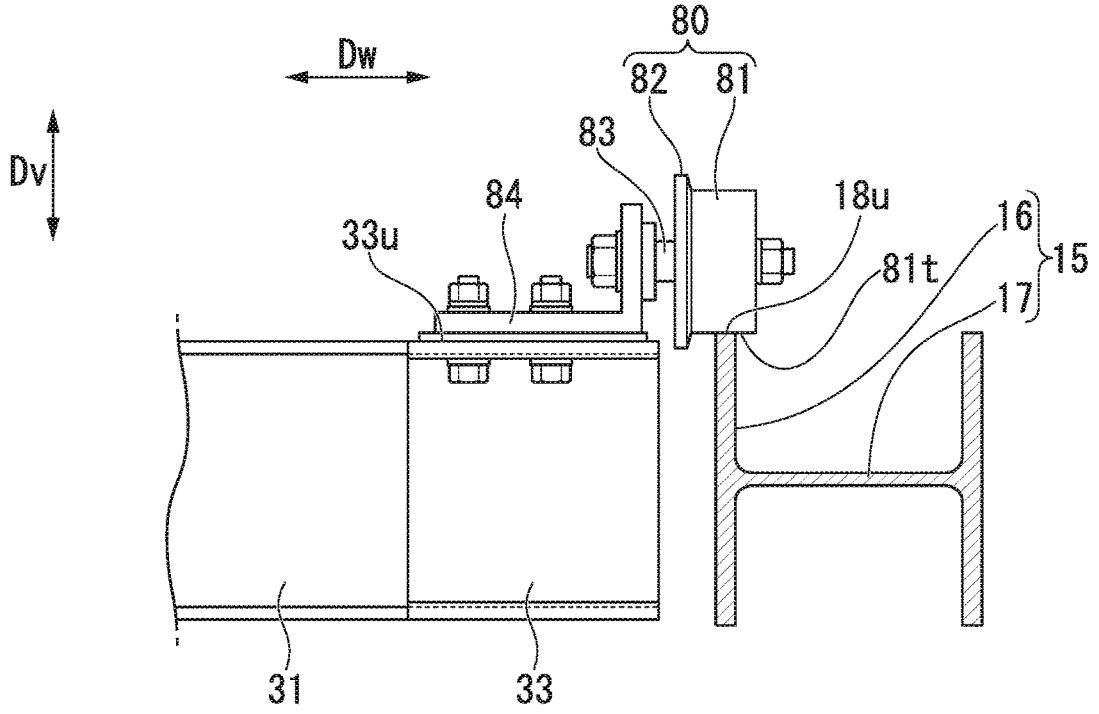
FIG. 8 is a front view of device traveling wheels in an embodiment of the present invention.

As shown in FIG. 8, the device traveling wheel 80 has a ring body 81 in which a tread surface 81*t* coming into contact with the top surface 18*u* of the guide rail 15 is formed on the outer periphery thereof, and a flange 82 which is formed integrally with the wheel body 81 and can come into contact with the guide rail 15 from the width direction Dw. Further, the top surface 18*u* of the guide rail 15 is a surface facing upward in the flange 16 on the travel path 11 side in the width direction Dw, among the pair of flanges 16 of the guide rail 15.

The device traveling wheel 80 is rotatably mounted onto a rotary shaft 83 extending in the width direction Dw. The rotary shaft 83 is fixed to the top surface 33*u* of the traveling wheel mounting base 33 via a shaft support 84.

Figure 4:
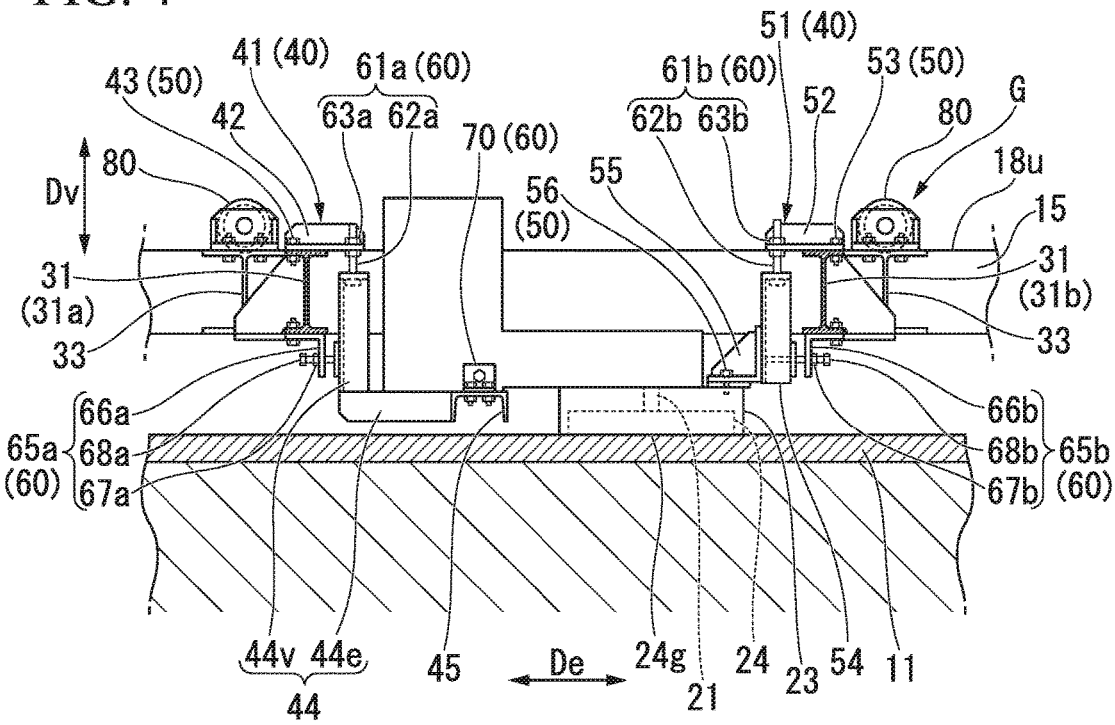
FIG. 4 is a cross-sectional view taken along line IV-IV in FIG. 2.

As shown in FIG. 4, the grinder 20 has a spindle 21 on which the grinding tool 24 is mounted, a grinder main body 22 which rotates the spindle 21, and a tool cover 23 which covers the grinding tool 24 mounted onto the spindle 21. The spindle 21 is provided in the grinder main body 22 to extend in the vertical direction Dv. The grinding tool 24 mounted onto the spindle 21 has a disc shape, and an end surface in a direction in which the spindle 21 extends constitutes a main grinding surface 24*g*. Therefore, in the grinding tool 24 in the state of being mounted onto the spindle 21, among the end surfaces in the vertical direction Dv in which the spindle 21 extends, the end surface facing downward forms the main grinding surface 24*g*. The tool cover 23 covers the side circumference and the upper side of the grinding tool 24. The tool cover 23 is fixed to the grinder main body 22.

The mounting structure 40 has a main body support structure 41 which supports the grinder main body 22, and a cover support structure 51 which supports the tool cover 23. The main body support structure 41 is mounted onto the first beam member 31*a* which is one of the pair of beam members 31, and the cover support structure 51 is mounted onto the second beam member 31*b* which is the other beam member 31.

The main body support structure 41 has a first bracket 42, a mounting bolt and a mounting nut 43 which mounts the first bracket 42 to the first beam member 31*a*, a second bracket 44, an up-down adjuster 61*a*, a front-rear adjuster 65*a*, a third bracket 45 fixed to the second bracket 44 to support the grinder main body 22 from below, and a width direction adjuster 71. The up-down adjuster 61*a* adjusts the relative position of the second bracket 44 in the vertical direction Dv with respect to the first bracket 42. The front-rear adjuster 65*a* adjusts the relative position of the second bracket 44 in the extending direction De with respect to the first beam member 31*a*. The width direction adjuster 71 adjusts the relative position of the grinder main body 22 in the width direction Dw with respect to the third bracket 45.

The first bracket 42 extends in the extending direction De, and one end thereof in the extending direction De is mounted onto the upper end of the first beam member 31*a* by the mounting bolt and the mounting nut 43. The second bracket 44 has an L-shaped configuration, and has an up-down beam portion 44*v* which corresponds to one side of the L shape and extends in the vertical direction Dv, and a front-rear beam portion 44*e* which corresponds to the other side of the L shape and extends toward the second beam member 31*b* side from the lower end of the up-down beam portions 44*v* in the extending direction De.

The up-down adjuster 61*a* has an up-down adjusting bolt 62*a* and an up-down adjusting nut 63*a*. The up-down adjusting nut 63*a* is mounted onto the end portion of the first bracket 42 in the extending direction De so as not to be relatively positioned. The bolt head portion of the up-down adjusting bolt 62*a* is mounted onto the upper end of the up-down beam portion 44*v* of the second bracket 44 so as not to be relatively positioned, and its screw portion extends upward from the bolt head portion. By adjusting the screwing amount of the up-down adjusting bolt 62*a* mounted onto the second bracket 44 with respect to the up-down adjusting nut 63*a* mounted onto the first bracket 42, it is possible to adjust the relative position of the second bracket 44 with respect to the first bracket 42 in the vertical direction Dv. Therefore, by manipulating the up-down adjuster 61*a*, it is possible to adjust the position of the grinder main body 22 supported by the third bracket 45 and the tool cover 23 fixed to the third bracket 45 in the vertical direction Dv with respect to the first bracket 42.

The front-rear adjuster 65*a* has a nut fixing base 66*a* fixed to the lower end of the first beam member 31*a*, a front-rear adjusting nut 67*a* fixed to the nut fixing base 66*a*, and a front-rear adjusting bolt 68*a* screwed into the front-rear adjusting nut 67*a*. The screw portion of the front-rear adjusting bolt 68*a* extends in the extending direction De in a state of being screwed into the front-rear adjusting nut 67*a*, and its tip is in contact with the second bracket 44. By adjusting the screwing amount of the front-rear adjusting bolt 68*a* with respect to the front-rear adjusting nut 67*a*, it is possible to adjust the relative position of the second bracket 44 with respect to the first beam member 31*a* in the extending direction De. Therefore, by operating the front-rear adjuster 65*a*, it is possible to adjust the positions of the grinder main body 22 supported by the third bracket 45 via the second bracket 44 and the tool cover 23 fixed thereto in the extending direction De. As described above, the front-rear adjuster 65*a* serves to adjust the positions of the grinder main body 22 and the tool cover 23 in the extending direction De, but it also serves to regulate the inclination of the second bracket 44 on the basis of the upper end of the second bracket 44.

As shown in FIG. 2, the two first brackets 42 and the two second brackets 44 are arranged in the width direction Dw. Therefore, there are also two up-down adjusters 61*a* which adjust the relative position of the second bracket 44 in the vertical direction Dv with respect to the first bracket 42, and two front-rear adjusters 65*a* which adjust the relative position of the second bracket 44 in the extending direction De with respect to the first beam member 31*a*.

Figure 5:
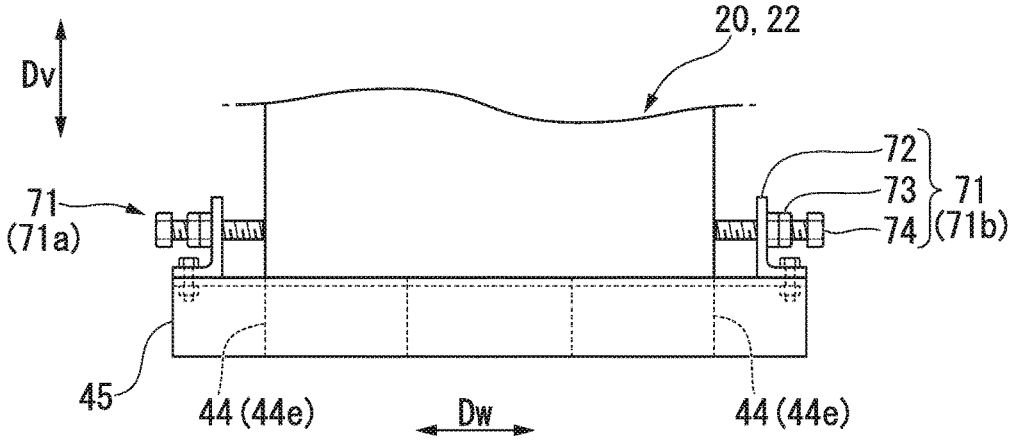
FIG. 5 is a cross-sectional view taken along line V-V in FIG. 2.

As shown in FIGS. 4 and 5, the third bracket 45 extends in the width direction Dw, and its end portion is fixed to the end portions of the front-rear beam portions 44*e* of the two second brackets 44. The grinder main body 22 is supported by the third bracket 45. The width direction adjuster 71 has a first width direction adjuster 71*a* mounted onto the first end portion of the third bracket 45 in the width direction Dw, and a second width direction adjuster 71*b* mounted onto the second end portion of the third bracket 45 in the width direction Dw.

Both of the first width direction adjuster 71*a* and the second width direction adjuster 71*b* have a nut fixing base 72, a width direction adjusting nut 73 fixed to the nut fixing base 72, and a width direction adjusting bolt 74 to be screwed into the width direction adjusting nut 73. The nut fixing base 72 of the first width direction adjuster 71*a* is fixed to the end portion of the front-rear beam portion 44*e* of one second bracket 44 among the two second brackets 44, and the nut fixing base 72 of the second width direction adjuster 71*b* is fixed to the end portion of the front-rear beam portion 44*e* of the other second bracket 44 among the two second brackets 44. The screw portion of the width direction adjusting bolt 74 extends in the width direction Dw in a state of being screwed into the width direction adjusting nut 73, and its tip is in contact with the grinder main body 22. By adjusting the screwing amount of the width direction adjusting bolt 74 with respect to the width direction adjusting nut 73, it is possible to adjust the relative position of the grinder main body 22 with respect to the third bracket 45 in the width direction Dw.

The cover support structure 51 has a first bracket 52, a mounting bolt and a mounting nut 53 which mounts the first bracket 52 to the second beam member 31*b*, a second bracket 54, an up-down adjuster 61*b*, a front-rear adjuster 65*b*, a third bracket 55 fixed to the second bracket 54, and a connection bolt and a connection nut 56 which connect the third bracket 55 and the tool cover 23 of the grinder 20. The up-down adjuster 61*b* adjusts the relative position of the second bracket 54 in the vertical direction Dv with respect to the first bracket 52. The front-rear adjuster 65*b* adjusts the relative position of the second bracket 54 in the extending direction De with respect to the second beam member 31*b*.

The first bracket 52 extends in the extending direction De, and one end portion in the extending direction De is mounted onto the upper end of the second beam member 31*b* by the mounting bolt and the mounting nut 53. The second bracket 54 extends in the vertical direction Dv.

The up-down adjuster 61*b* has an up-down adjusting bolt 62*b* and an up-down adjusting nut 63*b*. The up-down adjusting nut 63*b* is mounted onto the end portion of the first bracket 52 in the extending direction De so as not to be relatively positioned. The bolt head portion of the up-down adjusting bolt 62*b* is mounted onto the upper end of the second bracket 54 so as not to be relatively positioned, and its screw portion extends upward from the bolt head portion. By adjusting the screwing amount of the up-down adjusting bolt 62*b* mounted onto the second bracket 54 with respect to the up-down adjusting nut 63*b* mounted onto the first bracket 52, it is possible to adjust the relative position of the second bracket 54 with respect to the first bracket 52 in the vertical direction Dv. Therefore, by operating the up-down adjuster 61*b*, it is possible to adjust the positions in the vertical direction Dv of the tool cover 23 supported on the third bracket 55 by the connection bolt and the connection nut 56, and the grinder main body 22 for fixing the tool cover 23, with respect to the first bracket 52.

The front-rear adjuster 65*b* has a nut fixing base 66*b* fixed to the lower end of the second beam member 31*b*, a front-rear adjusting nut 67*b* fixed to the nut fixing base 66*b*, and a front-rear adjusting bolt 68*b* screwed into the front-rear adjusting nut 67*b*. The screw portion of the front-rear adjusting bolt 68*b* extends in the extending direction De in a state of being screwed into the front-rear adjusting nut 67*b*, and the tip thereof is in contact with the second bracket 54. By adjusting the screwing amount of the front-rear adjusting bolt 68*b* with respect to the front-rear adjusting nut 67*b*, it is possible to adjust the relative position of the second bracket 54 with respect to the second beam member 31*b* in the extending direction De. Therefore, by operating the front-rear adjuster 65*b*, it is possible to adjust the positions in the extending direction De of the tool cover 23 supported on the third bracket 55 by the connection bolt and the connection nut 56, and the grinder main body 22 to which the tool cover 23 is fixed. As described above, the front-rear adjuster 65*b* serves to adjust the positions of the tool cover 23 and the grinder main body 22 in the extending direction De, but the front-rear adjuster 65*b* also serves to restrict the inclination of the second bracket 54 on the basis of the upper end of the second bracket 54.

By operating the up-down adjuster 61*a* of the main body support structure 41 and the up-down adjuster 61*b* of the cover support structure 51 as described above, it is possible to adjust the relative position of the grinder 20 in the vertical direction Dv with respect to the frame 30. Therefore, by operating the up-down adjuster 61*a* of the main body support structure 41 and the up-down adjuster 61*b* of the cover support structure 51, it is also possible to set the position of the grinder 20 in the vertical direction Dv at a position where the grinding tool 24 cannot come into contact with the portion of the travel path 11 to be ground, in the state in which the device traveling wheels 80 come into contact with the top surfaces 18*u* of the guide rails 15. However, in the present embodiment, if the device traveling wheels 80 come into contact with the top surfaces 18*u* of the guide rails 15, the grinding tool 24 can be reliably brought into contact with the portion of the travel path 11 to be ground, within the adjustment range of the relative position of the grinder 20 with respect to the frame 30 in the vertical direction Dv. That is, in the present embodiment, the grinder 20 is provided in the frame 30 via the mounting structure 40 at a position where the grinding tool 24 can come into contact with the portion of the travel path 11 to be ground, in the state in which the device traveling wheels 80 come into contact with the top surface 18*u* of the guide rail 15.

In this embodiment, among the components of the aforementioned mounting structure 40, the up-down adjuster 61*a*, the front-rear adjuster 65*a* and the width direction adjuster 71 of the main body support structure 41, the up-down adjuster 61*b* and the front-rear adjuster 65*b* of the cover support structure 51 constitute a grinder moving mechanism 60 which relatively moves the grinder 20 with respect to the frame 30. Further, among the components of the mounting structure 40, the mounting bolt and the mounting nut 43 of the main body support structure 41, and the mounting bolt and the mounting nut 53 of the cover support structure 51 constitute a grinder mounting tool 50 which mounts the grinder 20 to the frame 30 in a detachable manner. Also, the front-rear adjusting bolts 68*a* and 68*b* of the front-rear adjusters 65*a* and 65*b*, the width direction adjusting bolt 74 of the width direction adjuster 71, and the connection bolt and the connection nut 56 of the cover support structure 51 also constitute the grinder mounting tool 50 which mounts the grinder 20 to the frame 30 in a attachable and detachable manner.

Figure 6:
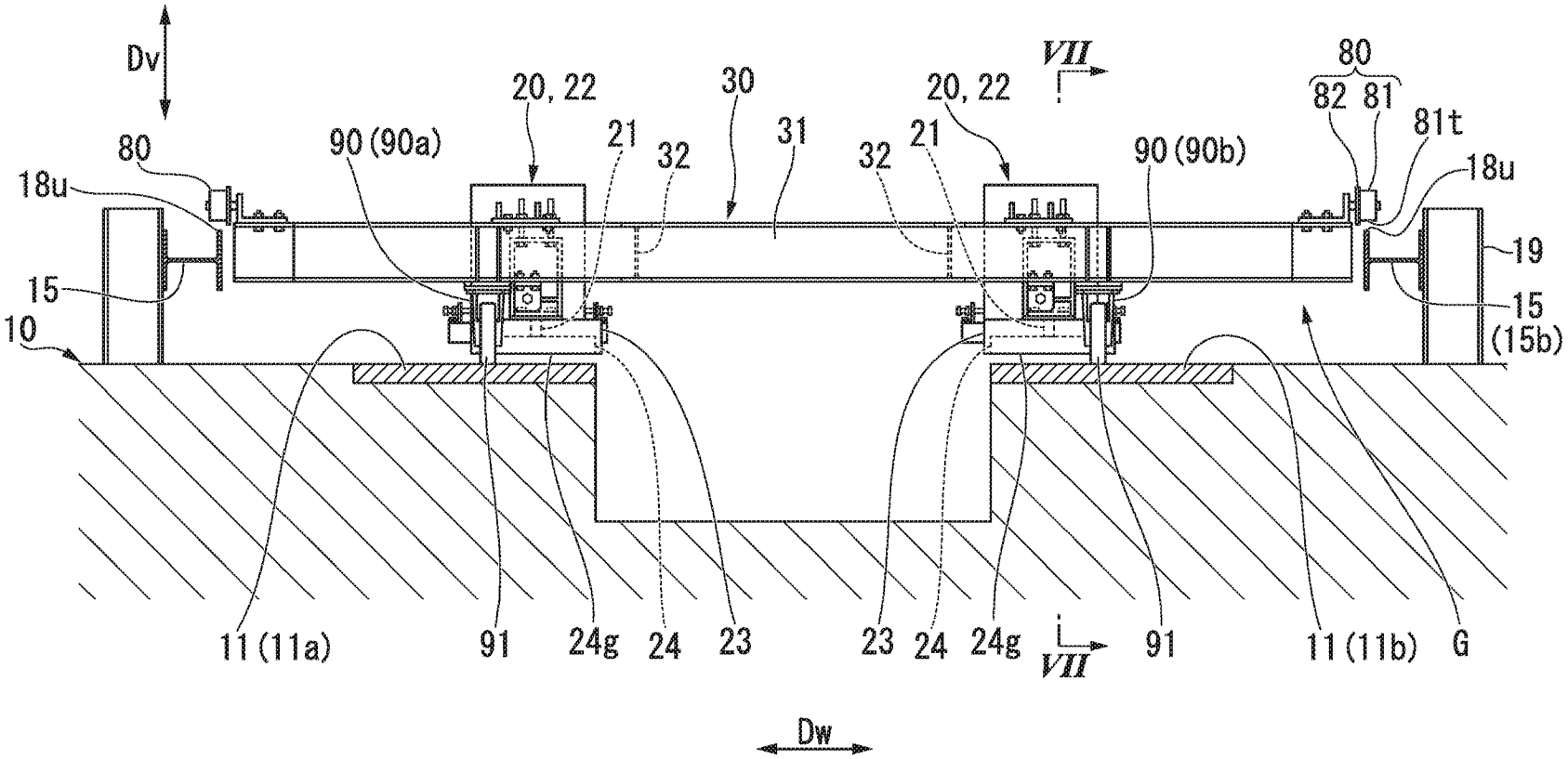
FIG. 6 is a rear view of the grinding device when auxiliary traveling wheels are mounted in an embodiment of the present invention.
Figure 7:
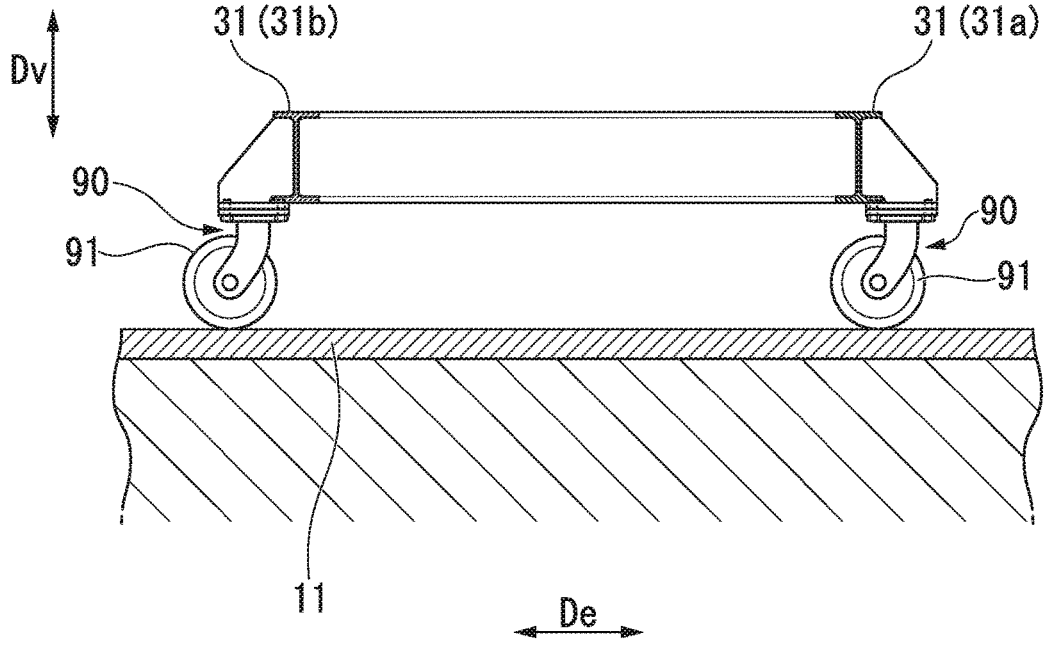
FIG. 7 is a cross-sectional view taken along line VII-VII in FIG. 6.

As shown in FIGS. 6 and 7, the grinding device G of the present embodiment further includes a caster 90 which is attachably and detachably mounted onto the frame 30 and has auxiliary traveling wheels 91 rolling on the top surface of the travel path 11. The caster 90 has two first casters 90*a* for traveling on the first travel path 11*a* and two second casters 90*b* for traveling on the second travel path 11*b*. One of the two first casters 90*a* is attachably and detachably mounted onto the first beam member 31*a* constituting the frame 30 by bolts and nuts, and the other first caster 90*a* is attachably and detachably mounted onto the second beam member 31*b* constituting the frame 30 by a bolt and a nut. Further, one of the two second casters 90*b* is attachably and detachably mounted onto the first beam member 31*a* constituting the frame 30 by bolts and nuts, and the other second caster 90*b* is attachably and detachably mounted onto the second beam member 31*b* constituting the frame 30 by bolts and nuts. In a state in which the caster 90 is mounted onto the frame 30 and the auxiliary traveling wheels 91 of the caster 90 come into contact with the travel path 11, the device traveling wheels 80 are separated upward from the top surface 18*u* of the guide rail 15.

Next, a grinding method for the travel path 11 using the above-described grinding device G will be described.

Figure 9:
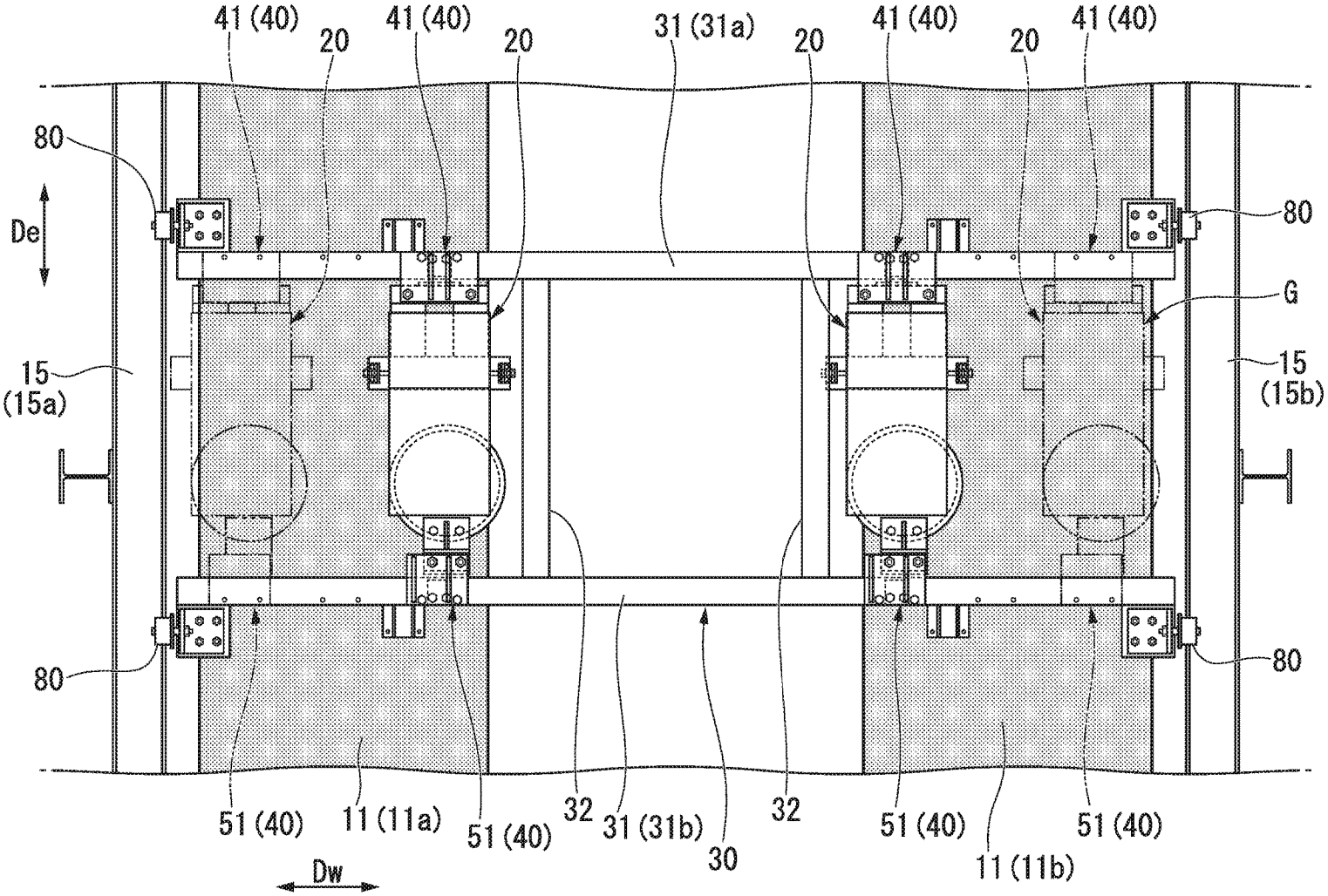
FIG. 9 is an explanatory view showing a movement mode of a grinder in the grinding device according to an embodiment of the present invention.

First, as shown in FIG. 6, the grinder 20 is mounted onto the frame 30 in a state where the caster 90 is attached via the mounting structure 40. In the present embodiment, the grinder 20 which grinds the first travel path 11*a* and the grinder 20 which grinds the second travel path 11*b* are mounted onto the frame 30. As shown in FIG. 9, it is possible to suitably change the mounting position of the mounting structure 40 with respect to the frame 30 in the width direction Dw. Therefore, it is also possible to change the mounting position of the grinder 20 supported by the mounting structure 40 with respect to the frame 30 in the width direction Dw.

Next, as shown in FIG. 6, the grinding device G is disposed on the track 10 so that the wheel bodies 81 of all the device traveling wheels 80 are positioned above the guide rails 15 and the auxiliary traveling wheels 91 of the casters 90 come into contact with the travel path 11. In this state, as described above, the device traveling wheels 80 are separated upward from the top surfaces 18*u* of the guide rails 15.

Next, the grinding device G is connected to a work vehicle or the like that can travel on the travel path 11. Further, by causing the work vehicle or the like to travel, the grinding device G connected to the work vehicle or the like is caused to travel, and the grinding device G is moved to the grinding operation start position of the travel path 11. At this time, the auxiliary traveling wheels 91 of the casters 90 roll on the travel path 11.

When the grinding device G is moved to the grinding operation start position, the grinder moving mechanism 60 is operated to relatively move the grinder 20 with respect to the frame 30, and the relative position between the travel path 11 and the grinding tool 24 of the grinder 20 is adjusted. At this time, in order to adjust the grinding depth, by operating the up-down adjuster 61*a* of the main body support structure 41 and the up-down adjuster 61*b* of the cover support structure 51, the relative position of the grinder 20 with respect to the frame 30 in the vertical direction Dv, in other words, the height of the grinding tool 24 mounted onto the spindle 21 of the grinder 20 is adjusted.

Further, the grinder 20 may be mounted onto the frame 30 at any point in time just before the position adjustment of the grinding tool 24.

When the position adjustment of the grinding tool 24 is completed, the caster 90 is removed from the frame 30 after driving the grinder 20. As shown in FIG. 3, the wheel bodies 81 of the device traveling wheels 80 come into contact with the top surfaces 18*u* of the guide rails 15, and the grinding tools 24 come into contact with the travel paths 11, and grinding of the travel paths 11 is started (grinding process). A portion having a height lower than other portions in the travel paths 11 may be prepared in advance, and this portion may be set as the grinding operation start position. In this case, even if the casters 90 are detached from the frame 30 and the wheel bodies 81 of the device traveling wheels 80 come into contact with the top surfaces 18*u* of the guide rails 15, the grinding tools 24 do not come into contact with the travel paths 11 of this portion. Therefore, in this case, after the casters 90 are detached from the frame 30 and the wheel bodies 81 of the device traveling wheels 80 come in contact with the top surfaces 18*u* of the guide rails 15, the grinder 20 may be driven.

Next, the work vehicle or the like is caused to travel, and the grinding device G connected to the work vehicle or the like is also caused to travel (traveling process). During the traveling process, the grinder 20 is driven, and the surface layer of the travel path 11 is ground by the grinder 20 (grinding process). Therefore, in the present embodiment, since the grinding process is executed during the traveling process of causing the grinding device G to travel along the travel path 11, the travel path 11 can be efficiently ground. Further, in the present embodiment, since the grinder 20 for grinding the first travel path 11*a* and the grinder 20 for grinding the second travel path 11*b* are mounted onto the frame 30, it is possible to simultaneously grind the first travel path 11*a* and the second travel path 11*b*. Therefore, in this embodiment, the travel path 11 can also be efficiently ground from this point of view.

The top surface 18*u* of the guide rail 15 has irregularities smaller than the top surface of the travel path 11 before grinding and is linear. In the traveling process, while the wheel bodies 81 of the device traveling wheels 80 come into contact with the top surfaces 18*u* of the guide rails 15, the device traveling wheels 80 roll on the top surfaces 18*u*. Therefore, during the traveling process, the relative position between the top surfaces 18*u* of the guide rails 15 and the grinding tools 24 in the vertical direction Dv is constant. Therefore, during the traveling process, the travel paths 11 are ground along the top surfaces 18*u* of the linear guide rails 15. Therefore, in the present embodiment, it is possible to enhance the flatness of the travel paths 11, and it is possible to improve the ride quality of the vehicle traveling on the travel paths 11.

Further, the flanges 82 of the device traveling wheels 80 can come into contact with the inner surfaces 18*i* of the guide rails 15 from the width direction Dw. Therefore, during the traveling process, the relative position change of the grinding devices G with respect to the guide rails 15 in the width direction Dw is restricted by the flanges 82 of the device traveling wheels 80. In other words, during the traveling process, relative position change of the grinders 20 relative to the guide rails 15 in the width direction Dw is suppressed. Therefore, in the present embodiment, even when the traveling process and the grinding process are performed in parallel, the relative position of grinding with respect to the guide rail 15 in the width direction Dw can be made substantially constant.

First Modified Example

Figure 11:
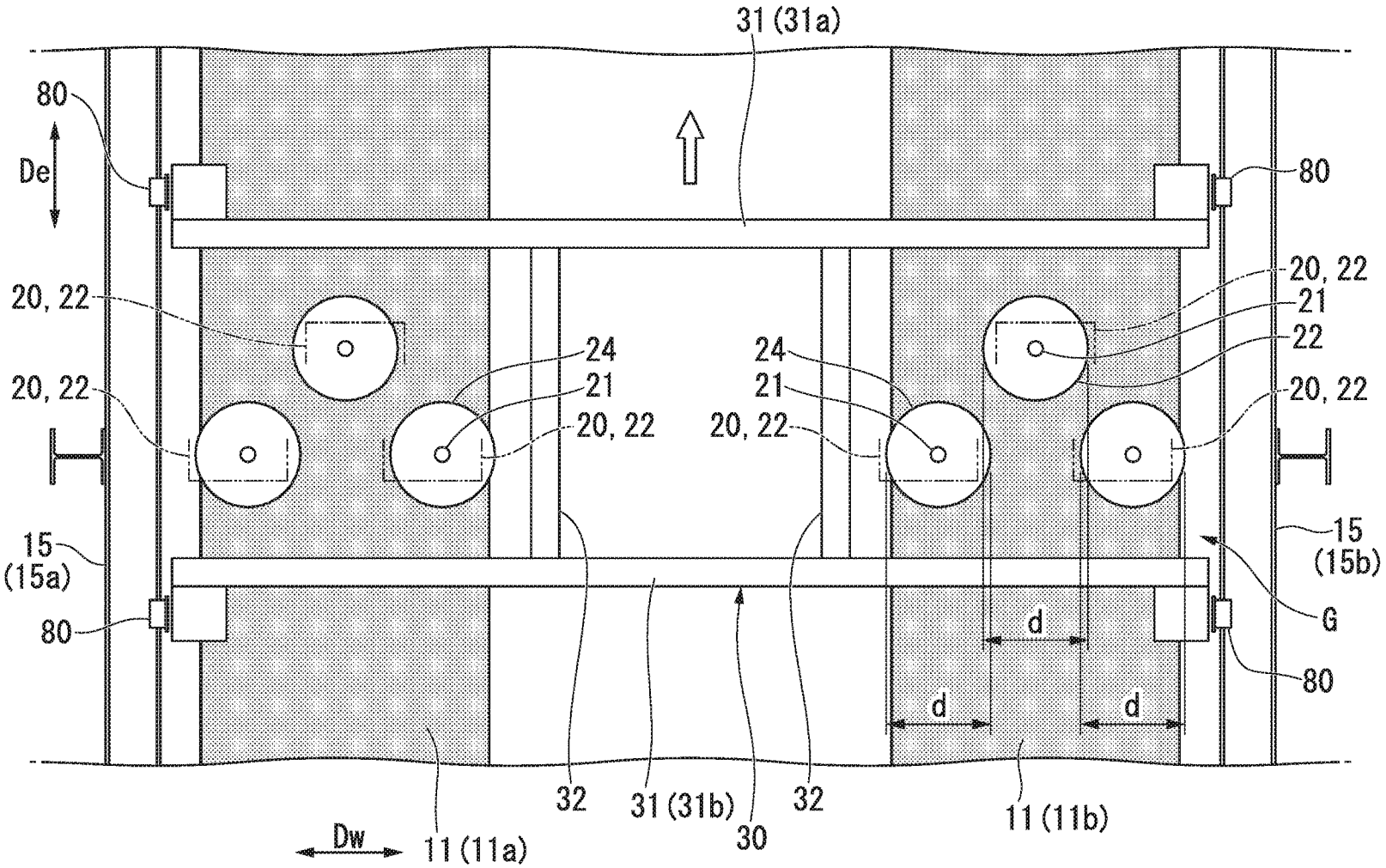
FIG. 11 is a schematic plan view of a grinding device in a first modified example of an embodiment according to the present invention.

A first modified example of the aforementioned embodiment will be described with reference to FIG. 11.

This modified example is an example for coping with the case where the width of the region to be ground in the travel path 11 is wider than the grinding width provided by a single grinding tool 24.

The grinding device G of the present modified example includes a plurality of grinders 20 which grind the first travel path 11*a*, and a plurality of grinders 20 which grind the second travel path 11*b*. The plurality of grinders 20 for grinding the first travel path 11*a* and the plurality of grinders 20 for grinding the second travel path 11*b* are arranged in the width direction Dw. Among the plurality of grinders 20 which grind the first travel path 11*a*, the mutual distance in the width direction Dw of the spindles 21 in the grinders 20 adjacent to each other in the width direction Dw is smaller than the diameter d of the grinding tool 24. Therefore, in the plurality of grinding tools 24 which grind the first travel path 11*a*, the grinding regions overlap each other in the width direction Dw. In the present embodiment, because the grinding regions of the plurality of grinding tools 24 are made to overlap each other in the width direction Dw, each grinder 20 is provided in the frame 30 such that the positions of the grinding tools 24 adjacent to each other in the width direction Dw are different from each other in the extending direction De. The plurality of grinders 20 which grind the second travel path 11*b* are also provided in the frame 30 in the same manner as the arrangement of the plurality of grinders 20 which grind the first travel path 11*a*.

As described above, in this modified example, even when the width of the region to be ground in the travel path 11 is wider than the grinding width of the single grinding tool 24, by driving the plurality of grinders 20, it is possible to grind the region to be ground over its entire width in a single travel without gaps.

As in the aforementioned embodiment, even when the grinder 20 for grinding the first travel path 11*a* and the grinder 20 for grinding the second travel path 11*b* are each one thing, and the width of the region to be ground in the travel path 11 is wider than the grinding width of a single grinding tool 24, it is possible to grind the travel path over the entire width of the region to be ground. In this case, the relative position of the grinder 20 with respect to the frame 30 in the width direction Dw is changed, and the grinding device G is caused to travel a plurality of times.

Second Modified Example

Figure 12:
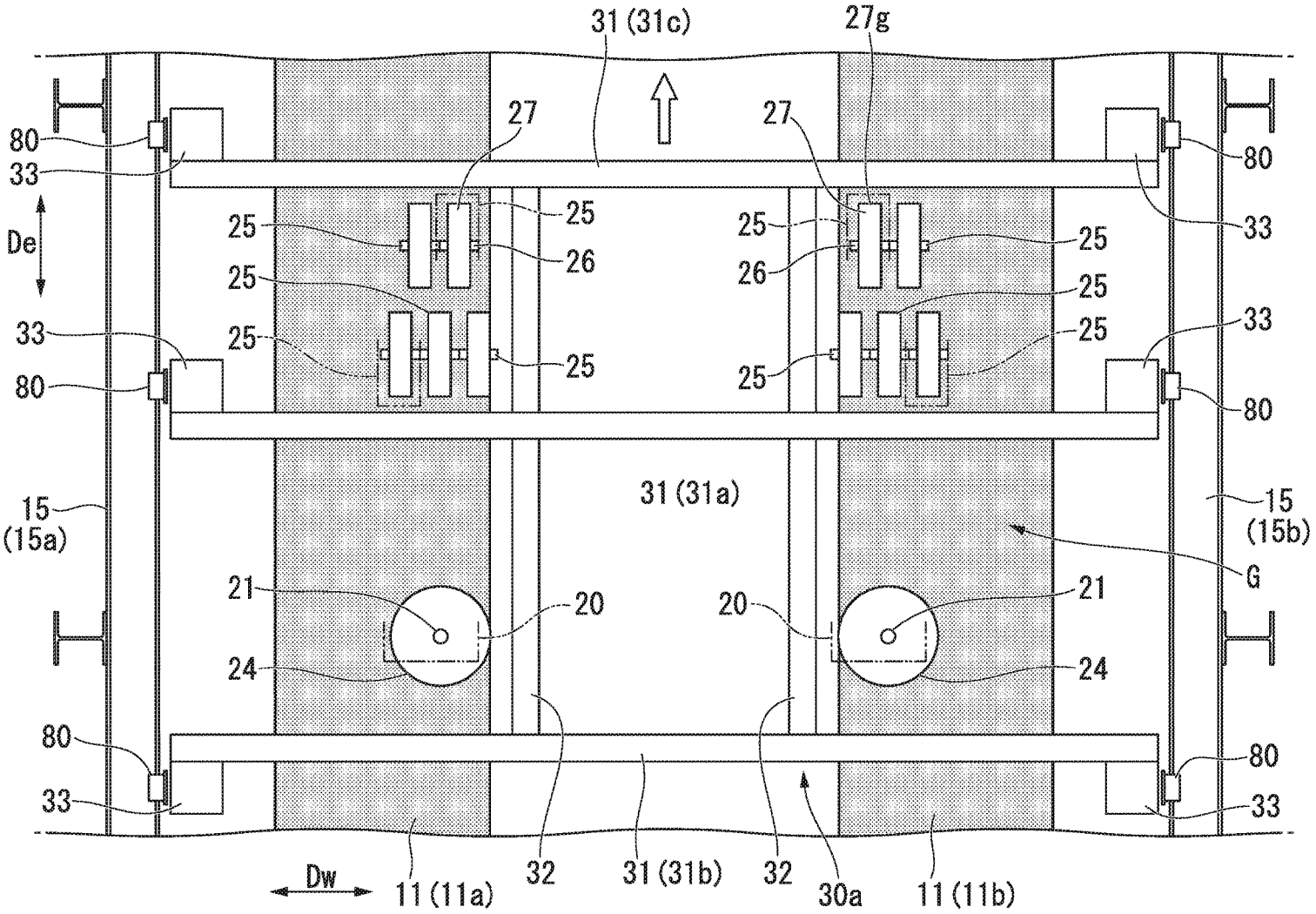
FIG. 12 is a schematic plan view of a grinding device in a second modified example of an embodiment according to the present invention.

A second modified example of the aforementioned embodiment will be described with reference to FIG. 12.

This modified example is an example for coping with a case where it is desired to increase the grinding depth.

The grinding device G of the present modified example includes a grinder 25 for rough grinding and a grinder 20 for finish grinding. The grinder 25 for rough grinding is disposed in front of the grinder 20 for finish grinding in the traveling direction of the grinding device G.

The frame 30*a* of the grinding device G of the present modified example has three beam members 31 extending in the width direction Dw and facing each other in the extending direction De, a pair of girder members 32 extending in the extending direction De and facing each other in the width direction Dw to connect the three beam members 31 to each other, and traveling wheel mounting base 33 on which the device traveling wheels 80 are mounted. Among the three beam members 31, as in the aforementioned embodiment, a grinder 20 for finish grinding is disposed between the first beam member 31*a* and the second beam member 31*b*. Further, among the three beam members 31, between the first beam member 31*a* and the third beam member 31*c* disposed in front of the first beam member 31*a*, a grinder 25 for rough grinding is disposed. The device traveling wheels 80 are mounted onto each of both end portions of the three beam members 31 in the width direction Dw. Here, the device traveling wheels 80 are mounted onto each of both end portions of all the beam members 31 in the width direction Dw, but the device traveling wheels 80 may be mounted only to both end portions of the second beam member 31*b* and the third beam member 31*c* in the width direction Dw.

Like the grinder 20 of the aforementioned embodiment, the grinder 20 for finish grinding has a spindle 21 extending in the vertical direction Dv. The grinding tool 24 mounted onto the spindle 21 has a disc shape, and the end surface in the direction in which the spindle 21 extends constitutes a main grinding surface 24*g* (shown in FIGS. 3 and 6). On the other hand, in the grinder 25 for rough grinding, the spindle 26 extends in the width direction Dw. The grinding tool 27 mounted onto the spindle 26 has a disc shape, and its outer peripheral surface forms a main grinding surface 27*g*. Therefore, the grinding width provided by the grinder 25 for rough grinding is generally narrower than the grinding width provided by the grinder 20 for finish grinding. Therefore, in order to widen the grinding width in rough grinding, a plurality of grinders 25 for rough grinding are arranged side by side in the width direction Dw as in the first modified example.

The grinder 25 in which the spindle 26 extends in the horizontal direction (the width direction Dw) can make the grinding depth deeper than that of the grinder 20 in which the spindle 21 extends in the vertical direction Dv. In addition, in the present modified example, the grinders 20 and 25 are arranged side by side in the extending direction De. Therefore, in the present modified example, by driving these grinders 20 and 25, it is possible to deeply grind the travel path 11 in a single travel.

Here, as the grinder 25 for rough grinding, the grinder 20 in which the spindle 26 extends in the horizontal direction (width direction Dw) is used. However, as long as the two grinders are arranged side by side in the extending direction De, any of the two grinders may have a spindle extending in the vertical direction Dv.

Further, here, the two grinders 20 and 25 are arranged side by side in the extending direction De. However, as long as a grinder having a spindle extending in the horizontal direction (width direction Dw) and capable of increasing the grinding depth is used, the two grinders 20 and 25 may not be arranged side by side in the extending direction De.

In addition, here, a single grinder 20 for finish grinding for grinding the first travel path 11*a* and a single grinder 20 for finish grinding for grinding the second travel path 11*b* may be provided. However, as in the first modified example, a plurality of grinders 20 for finish grinding for grinding the first travel path 11*a*, and a plurality of grinders 20 for finish grinding for grinding the second travel path 11*b* may be provided. In this case, a grinder 25 for rough grinding is disposed in front of each of a plurality of grinders 20 for finish grinding for grinding the first travel path 11*a*. Further, the grinder 25 for rough grinding is disposed in front of each of a plurality of grinders 20 for finish grinding for grinding the second travel path 11*b*.

Third Modified Example

Figure 13:
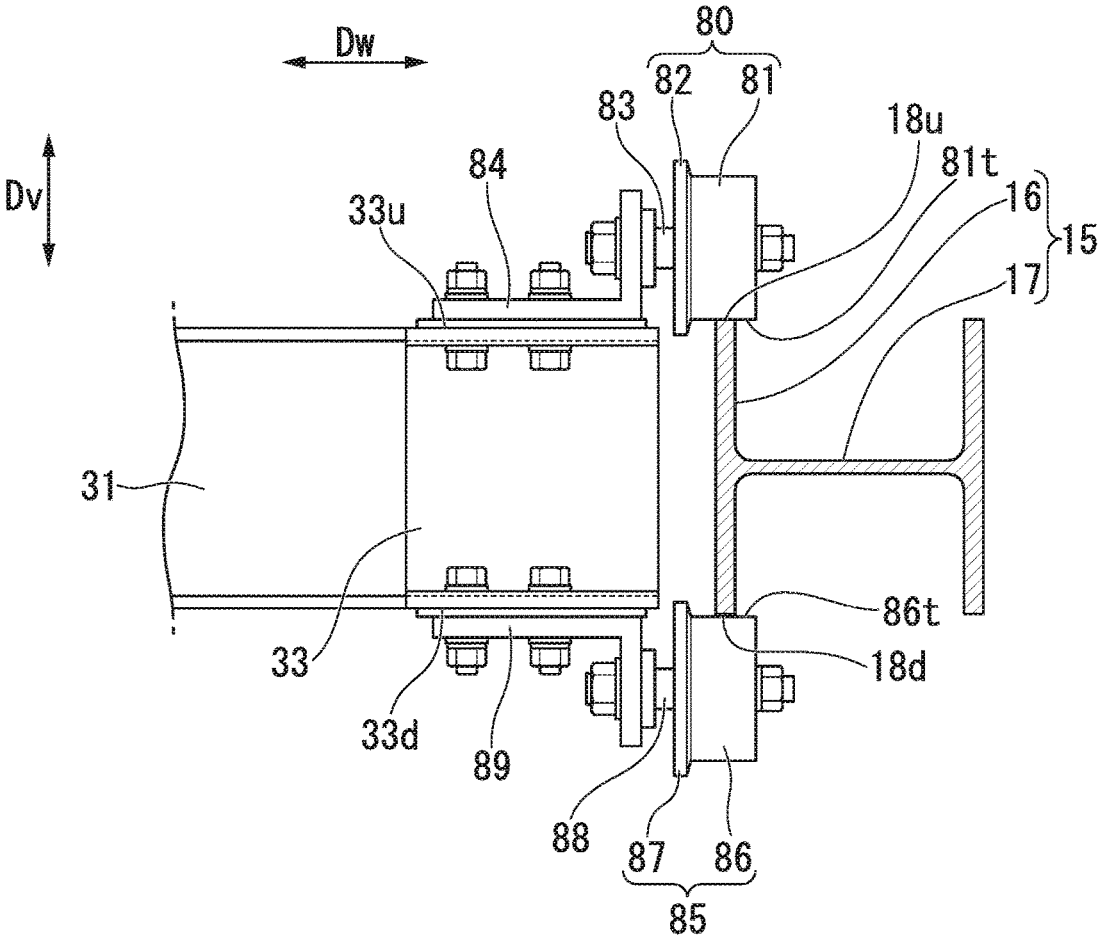
FIG. 13 is a front view of device traveling wheels and device guide wheels in a third modified example of an embodiment according to the present invention.

A third modified example of the aforementioned embodiment will be described with reference to FIG. 13.

When the grinding resistance in the vertical direction Dv is large in grinding of the travel path 11 using the grinder 20, a case where the traveling wheels 80 of the grinding device G are separated from the top surfaces 18*u* of the guide rails 15 by the grinding resistance is considered. For example, there is a case where a relatively large and hard stone or the like exists locally in the surface layer portion of the travel path 11, or a case where the grinding depth of the grinder 20 is deepened. In these cases, it is considered that the grinding resistance in the vertical direction Dv increases and the device traveling wheels 80 of the grinding device G are separated from the top surfaces 18*u* of the guide rails 15. This modified example is an example for coping with such cases.

The grinding device of this modified example further includes device guide wheels 85 which come into contact with the bottom surfaces 18*d* of the guide rails 15 and sandwich the guide rail 15 from the vertical direction Dv between the device traveling wheels 80 and the device guide wheels 85. Like the device traveling wheels 80, the device guide wheels 85 include a wheel body 86 having a tread surface 86*t* formed on its outer periphery, and a flange 87 integrally formed with the wheel body 86 and capable of coming into contact with the guide rail 15 from the width direction Dw. The device guide wheels 85 are rotatably mounted onto a rotary shaft 88 extending in a direction parallel to the rotary shaft 83 of the device traveling wheels 80. The rotary shaft 88 is fixed to the bottom surface 33*d* of the traveling wheel mounting base 33 via a shaft support 89.

In a state in which the wheel bodies 81 of the device traveling wheels 80 are in contact with the top surfaces 18*u* of the guide rails 15, a slight gap in the vertical direction Dv is provided between the wheel bodies 86 of the device guide wheels 85 and the bottom surfaces 18*d* of the guide rail 15. This is for the purpose of reducing the traveling resistance during travel of the grinding device G, while restricting the relative movement of the grinding device G in the vertical direction Dv with respect to the guide rail 15.

It is assumed that the rotary shafts 88 of the device guide wheels 85 are fixed to the bottom surfaces 33*d* of the traveling wheel mounting bases 33 via the shaft support 89. In this case, when the grinding device G is disposed on the track 10 so that the wheel bodies 81 of the device traveling wheels 80 are positioned above the guide rails 15, due to the existence of the device guide wheels 85, it is not possible to position the grinding device G above this state. Therefore, it is not possible to perform traveling of the auxiliary traveling wheels 91 of the casters 90 described in the aforementioned embodiment.

Therefore, when the mounting of the caster 90 is premised, the rotary shaft 88 of the device guide wheel 85 can be attached to or detached from the frame 30, or a mechanism capable of relatively displacing the position of the rotary shaft 88 relative to the frame 30 may be provided separately.

Other Modified Examples

In the aforementioned embodiment, the guide rails 15 with which the guide wheels 5 of the rail-type vehicle 1 come into contact are used as the standard rails on which the device traveling wheels 80 roll. However, rails provided separately from the guide rail 15 may be used as the standard rails. However, as in the above-described embodiment, when using the guide rails 15 as the standard rails, it is possible to reduce the equipment costs as compared with the case where the standard rails are provided separately.

The frame 30 of the aforementioned embodiment is configured to have a pair of beam members 31 extending in the width direction Dw and facing each other in the extending direction De, and a pair of girder members 32 extending in the extending direction De and facing each other in the width direction Dw to connect the pair of beam members 31 to each other. However, the frame 30 may not have the same configuration as that of the above-described embodiment, as long as it is configured to allow mounting of the device traveling wheel 80 and the grinder 20.

All of the up-down adjuster 61*a*, the front-rear adjuster 65*a* and the width direction adjuster 71 of the main body support structure 41 in the grinder moving mechanism 60 of the aforementioned embodiment, and the up-down adjuster 61*b* and the front-rear adjuster 65*b* of the cover support structure 51 are configured to have bolts and nuts. However, these adjusters may be constituted by other mechanisms such as, for example, a rack and pinion mechanism, a mechanical jack and a hydraulic jack.

INDUSTRIAL APPLICABILITY

According to one aspect of the present invention, it is possible to efficiently grind the travel paths on which the traveling wheels of a rail-type vehicle roll.

REFERENCE SIGNS LIST

1 rail-type vehicle
2 vehicle body
3 traveling tire (traveling wheel)
4 guide device
5 guide wheel
10 side-type guide track (simply, track)
11 travel path
11*a* first travel path
11*b* second travel path
15 side guide rail (guide rail, standard rail)
16 flange
17 web
18*u* top surface
18*d* bottom surface
20, 25 grinder
21, 26 spindle
22 grinder main body
23 tool cover
24, 27 grinding tool
24*g*, 27*g* grinding surface
30, 30*a* frame
31 beam member
31*a* first beam member
31*b* second beam member
31*c* third beam member
32 girder member
33 traveling wheel mounting base
40 mounting structure
41 main body support structure
50 grinder mounting tool
51 cover support structure
60 grinder moving mechanism
61*a*, 61*b* up-down adjuster
62*a*, 62*b* up-down adjusting bolt
63*a*, 63*b* up-down adjusting nuts
65*a*, 65*b* front-rear adjuster
66*a*, 66*b* nut fixing base
67*a*, 67*b* front-rear adjusting nut
67*a*, 68*a*, 68*b* front-rear adjusting bolt
68*a*, 71, 71*a*, 71*b* width direction adjuster
72 nut fixing base
73 width direction adjusting nut
74 width direction adjusting bolt
80 device traveling wheel
81 wheel body
81*t* tread surface
82 flange
85 device guide wheel
86 wheel body
86*t* tread surface
87 flange
90 caster
90*a* first caster
90*b* second caster
91 auxiliary traveling wheel

The invention claimed is:

1. A travel path grinding device for grinding a travel path on which traveling wheels of a rail-type vehicle roll, the device comprising:

a grinder which grinds a surface layer of the travel path;

a frame on which the grinder is provided;

a device traveling wheel which is mounted on the frame, is configured to come into contact with a top surface of a standard rail extending in an extending direction of the travel path along the travel path, and is configured to roll on the top surface; and auxiliary traveling wheels which are attachably and detachably mounted onto the frame and capable of rolling on a top surface of the travel path, in the state such that the device travelling wheel is separated from the top surface of the standard rail.

2. The travel path grinding device according to claim 1, wherein in a state in which the device traveling wheel comes into contact with the top surface of the standard rail, at a position where a grinding tool mounted onto a spindle of the grinder is capable of coming into contact with a portion of the travel path to be ground, the grinder is fixed to the frame.

3. The travel path grinding device according to claim 1, wherein the device traveling wheel has a wheel body in which a tread surface coming into contact with the top surface of the standard rail is formed on an outer periphery thereof, and only one flange which is provided on the wheel body and is capable of coming into contact with the standard rail from a width direction of the travel path, and the flange is capable of coming into contact with the standard rail from the side of the frame in the width direction.

4. The travel path grinding device according to claim 1, further comprising:

a grinder moving mechanism which relatively moves the grinder with respect to the frame, and fixes the grinder at the position relatively moved to.

5. The travel path grinding device according to claim 4, wherein the grinder moving mechanism relatively moves the grinder in the vertical direction with respect to the frame.

6. The travel path grinding device according to claim 1, wherein a spindle of the grinder on which a grinding tool is mounted extend in the vertical direction.

7. The travel path grinding device according to claim 1, further comprising:

a device guide wheel which is mounted on the frame and faces a bottom surface of the standard rail to sandwich the standard rail from the vertical direction between the device traveling wheel and the device guide wheel.

8. The travel path grinding device according to claim 1, further comprising:

a plurality of the grinders.

9. The travel path grinding device according to claim 8, wherein at least some grinders among the plurality of the grinders are arranged side by side in the width direction of the travel path and mounted onto the frame.

10. The travel path grinding device according to claim 8, wherein at least some grinders among the plurality of the grinders are arranged side by side in the extending direction of the travel path and mounted onto the frame.

11. The travel path grinding device according to claim 1, further comprising:

a mounting structure which detachably mounts the grinder to the frame.

12. The travel path grinding device according to claim 1, further comprising:

a grinding tool mounted on the grinder, wherein the grinding tool has a flat lower surface which faces downward and faces the travel path, and a side surface which linearly extends upward from an edge of the lower surface and faces the extending direction of the travel path.

13. A travel path grinding method for grinding the travel path, using a travel path grinding device for grinding a travel path on which traveling wheels of a rail-type vehicle roll, the device comprising a grinder which grinds a surface layer of the travel path; a frame on which the grinder is provided; a device traveling wheel which is mounted on the frame, is configured to come into contact with a top surface of a standard rail extending in an extending direction of the travel path along the travel path, and is configured to roll on the top surface; and auxiliary traveling wheels which are attachably and detachably mounted onto the frame and capable of rolling on a top surface of the travel path, in the state such that the device travelling wheel is separated from the top surface of the standard rail, the method comprising:

causing the grinding device to travel along the travel path so that the device traveling wheel of the grinding device comes into contact with the top surface of the standard rail and rolls on the top surface; and grinding the surface layer of the travel path by driving the grinder during travel.

14. The method according to claim 13, wherein during travel, a guide rail with which the guide wheel of the rail-type vehicle comes into contact to guide the direction of the rail-type vehicle is used as the standard rail.

* * * * *